US011450972B2

(12) United States Patent
Wang et al.

(10) Patent No.: US 11,450,972 B2
(45) Date of Patent: Sep. 20, 2022

(54) POWER DISTRIBUTION NETWORK, LIQUID CRYSTAL ANTENNA AND COMMUNICATION DEVICE

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Ying Wang, Beijing (CN); Tienlun Ting, Beijing (CN); Xiangzhong Kong, Beijing (CN); Jie Wu, Beijing (CN); Liang Li, Beijing (CN); Peizhi Cai, Beijing (CN); Chuncheng Che, Beijing (CN); Hao Liu, Beijing (CN)

(73) Assignees: BEIJING BOE OPTOELECTRONICS TECHNOLOGY CO., LTD., Beijing (CN); BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 63 days.

(21) Appl. No.: 16/640,619

(22) PCT Filed: Jun. 27, 2019

(86) PCT No.: PCT/CN2019/093193
§ 371 (c)(1),
(2) Date: Feb. 20, 2020

(87) PCT Pub. No.: WO2020/001519
PCT Pub. Date: Jan. 2, 2020

(65) Prior Publication Data

US 2020/0185836 A1 Jun. 11, 2020

(30) Foreign Application Priority Data

Jun. 27, 2018 (CN) ..... 201810676301.4

(51) Int. Cl.
*H01Q 21/00* (2006.01)
*H01Q 1/36* (2006.01)
(Continued)

(52) U.S. Cl.
CPC ..... *H01Q 21/0075* (2013.01); *H01P 1/182* (2013.01); *H01Q 1/364* (2013.01);
(Continued)

(58) Field of Classification Search
CPC ..... H01Q 21/0075; H01Q 1/364; H01Q 1/38; H01Q 21/061; H01Q 21/065; H01Q 3/36; H01P 1/182
See application file for complete search history.

(56) References Cited

U.S. PATENT DOCUMENTS

2008/0036664 A1 2/2008 Haziza
2014/0266897 A1* 9/2014 Jakoby ..... H01Q 1/44 342/368
(Continued)

FOREIGN PATENT DOCUMENTS

CN 103560324 A 2/2014
CN 103975483 A 8/2014
(Continued)

OTHER PUBLICATIONS

E. Hammerstad and O. Jensen, "Accurate Models for Microstrip Computer-Aided Design," 1980 IEEE MTT-S International Microwave symposium Digest, 1980, pp. 407-409, doi: 10.1109/MWSYM.1980.1124303. (Year: 1980).*
(Continued)

*Primary Examiner* — Andrea Lindgren Baltzell
*Assistant Examiner* — Yonchan J Kim
(74) *Attorney, Agent, or Firm* — Womble Bond Dickinson (US) LLP

(57) ABSTRACT

Embodiments of the present disclosure provide a power distribution network, a liquid crystal antenna including the
(Continued)

power distribution network, and a communication device including the liquid crystal antenna. The power distribution network is configured to be used in a liquid crystal antenna and includes a plurality of cascaded power distributors. Each of the plurality of cascaded power distributors comprises a first microstrip line, a transmission medium region and a reference electrode. A tangent value of a dielectric loss angle of a transmission medium in the transmission medium region is smaller than a tangent value of a dielectric loss angle of a liquid crystal in the liquid crystal antenna.

8 Claims, 3 Drawing Sheets

(51) Int. Cl.

| | |
|---|---|
| ***H01P 1/18*** | (2006.01) |
| ***H01Q 1/38*** | (2006.01) |
| ***H01Q 21/06*** | (2006.01) |
| ***H01Q 3/36*** | (2006.01) |

(52) U.S. Cl.
CPC ..... *H01Q 1/38* (2013.01); *H01Q 3/36* (2013.01); *H01Q 21/065* (2013.01)

(56) References Cited

U.S. PATENT DOCUMENTS

| | | | | |
|---|---|---|---|---|
| 2015/0123748 | A1 | 5/2015 | Stevenson et al. | |
| 2018/0062272 | A1* | 3/2018 | Haziza | H01Q 9/0407 |
| 2018/0342789 | A1* | 11/2018 | Jiang | H01Q 21/065 |
| 2019/0103671 | A1* | 4/2019 | Dong | H01Q 9/0407 |
| 2021/0184344 | A1* | 6/2021 | Furuhi | H01Q 1/243 |

FOREIGN PATENT DOCUMENTS

| | | | |
|---|---|---|---|
| CN | 108196405 | A | 6/2018 |
| CN | 208298996 | U | 12/2018 |

OTHER PUBLICATIONS

International Search Report received for PCT Patent Application No. PCT/CN2019/093193, dated Sep. 12, 2019, 5 pages (2 pages of English Translation and 3 pages of Original Document).

* cited by examiner

POWER DISTRIBUTION NETWORK, LIQUID CRYSTAL ANTENNA AND COMMUNICATION DEVICE

RELATED APPLICATIONS

The present application is a 35 U.S.C. 371 national stage application of a PCT International Application No. PCT/CN2019/093193, filed on Jun. 27, 2019, which claims the benefit of Chinese Patent Application No. 201810676301.4, filed on Jun. 27, 2018, the entire disclosures of which are incorporated herein by reference.

TECHNICAL FIELD

The present disclosure relates generally to the field of communication technologies. More specifically, the present disclosure relates to a power distribution network, a liquid crystal antenna including the power distribution network, and a communication device using the liquid crystal antenna.

BACKGROUND

In a typical liquid crystal array antenna system, the power distribution network distributes input power evenly to multiple output terminals through one-divided-two power distributors which are cascaded. Generally, the power distribution network is required to complete the feeding of the array elements without causing damage to the continuity of other structures or causing minor impact. Power distributors can be divided into microstrip structure power distributors and cavity power distributors according to their different structures. In liquid crystal array antennas, a microstrip structure power distributor is usually used. Compared with the cavity power distributor, the microstrip structure power distributor has greater isolation and higher integration, but has a larger insertion loss. Therefore, there is a need in the art for a low-loss power distribution network suitable for a highly efficient liquid crystal antenna.

SUMMARY

In view of this, an aspect of the present disclosure provides a power distribution network configured to be used in a liquid crystal antenna comprising: a plurality of cascaded power distributors, each of the plurality of cascaded power distributors comprising a first microstrip line, a transmission medium region and a reference electrode. A tangent value of a dielectric loss angle of a transmission medium in the transmission medium region is smaller than a tangent value of a dielectric loss angle of a liquid crystal in the liquid crystal antenna.

According to some embodiments of the present disclosure, the first microstrip line comprises a plurality of sub-microstrip lines with different impedances, and each power distributor further comprises a first impedance transformer electrically coupled between the first microstrip lines with different impedances.

According to some embodiments of the present disclosure, the transmission medium in the transmission medium region is air.

According to some embodiments of the present disclosure, a width of the first microstrip line satisfies the following formula:

$$Z_{01} = \frac{60}{\sqrt{\varepsilon_{e1}}} \ln\left[\frac{\mu_1}{w_1/h_1} + \sqrt{1 + \left(\frac{2}{w_1/h_1}\right)^2}\right]$$

where $Z_{01}$ represents a characteristic impedance of the first microstrip line, $\varepsilon_{e1}$ represents an effective dielectric constant of the transmission medium in the transmission medium region, $\mu_1$ represents a magnetic permeability of the transmission medium in the transmission medium region, $w_1$ represents a width of the first microstrip line, and $h_1$ represents a thickness of the transmission medium region.

Another aspect of the present disclosure provides a liquid crystal antenna. The liquid crystal antenna comprises a first substrate and a second substrate opposite to each other; a plurality of radiating devices on a side of the first substrate away from the second substrate; any one of the above power distribution networks configured to feed electromagnetic signals to the plurality of radiating devices; and a phase shifter. The phase shifter comprises a plurality of liquid crystal regions between the first substrate and the second substrate; a reference electrode between the first substrate and the plurality of liquid crystal regions; and a second microstrip line between the second substrate and the plurality of liquid crystal regions. Respective one of the plurality of liquid crystal regions corresponds to respective one of the plurality of radiating devices, and an orthographic projection of each radiating device on the second substrate at least partially overlaps with an orthographic projection of the corresponding liquid crystal region on the second substrate. A transmission medium region of each power distributor is between adjacent liquid crystal regions, the reference electrode of each power distributor is between the first substrate and the transmission medium region, and the first microstrip line of each power distributor is between the second substrate and the transmission medium region.

According to some embodiments of the present disclosure, the transmission medium region and the adjacent liquid crystal region are separated by a wall.

According to some embodiments of the present disclosure, the wall is made of a frame sealant.

According to some embodiments of the present disclosure, the liquid crystal antenna further comprises a second impedance transformer electrically coupled between the first microstrip line and the second microstrip line adjacent to each other.

According to some embodiments of the present disclosure, a width of the second microstrip line satisfies the following formula:

$$Z_{02} = \frac{60}{\sqrt{\varepsilon_{e2}}} \ln\left[\frac{\mu_2}{w_2/h_2} + \sqrt{1 + \left(\frac{2}{w_2/h_2}\right)^2}\right]$$

where $Z_{02}$ represents a characteristic impedance of the second microstrip line, $\varepsilon_{e2}$ represents an effective dielectric constant of the liquid crystal in the liquid crystal region, $\mu_2$ represents a magnetic permeability of the liquid crystal in the liquid crystal region, $w_2$ represents a width of the second microstrip line, and $h_2$ represents a thickness of the liquid crystal region.

Another aspect of the present disclosure provides a communication device comprising any one of the above liquid crystal antennas.

It should be understood that the above general description and the following detailed description are merely exemplary and explanatory and are not intended to limit the present disclosure in any way.

BRIEF DESCRIPTION OF THE DRAWINGS

In order to more clearly illustrate the technical solutions in embodiments of the disclosure, the accompanying drawings needed to be used in the description of the embodiments will be introduced briefly in the following. Obviously, the drawings in the following description represent only some embodiments of the disclosure. It should be noted that the dimensions shown in the drawings are only schematic and are not intended to limit the present disclosure in any way.

The embodiments of the present disclosure have been shown clearly in connection with the drawings, which will be described in more detail below. These drawings and descriptions are not intended to limit the scope of the present disclosure in any way, but to explain the concepts of the present disclosure to those of ordinary skill in the art with reference to specific embodiments.

DETAILED DESCRIPTION OF EMBODIMENTS

To make the objectives, technical solutions, and advantages of the embodiments of the present disclosure clearer, the technical solutions of the embodiments of the present disclosure will be further described in detail below with reference to the accompanying drawings.

Figure 1:
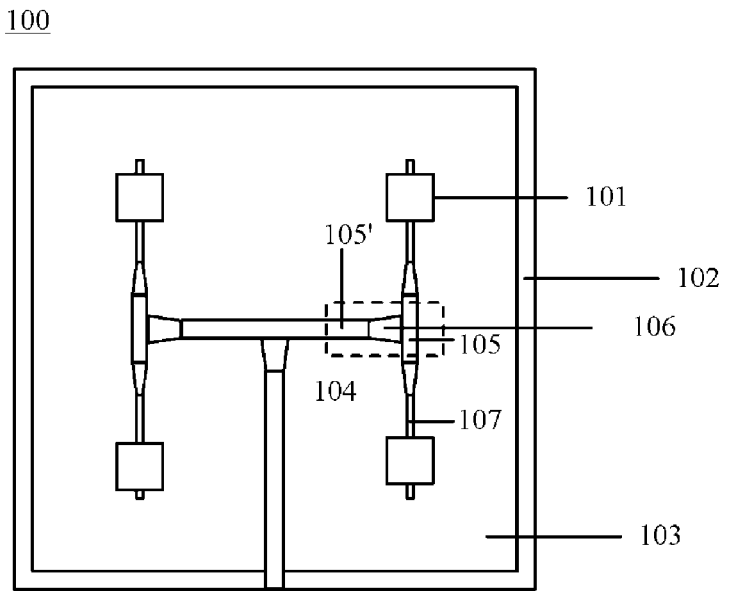
FIG. 1 schematically illustrates a top view of a conventional liquid crystal antenna.

FIG. 1 schematically illustrates a top view of a conventional liquid crystal antenna. As shown in FIG. 1, the liquid crystal antenna 100 includes a plurality of radiating devices 101, a power distribution network, and a phase shifter. The power distribution network includes a plurality of cascaded power distributors 104, each power distributor 104 including microstrip lines 105, 105', and a corresponding portion of the liquid crystal region 103 enclosed by a frame sealant 102. The power distribution network is configured to feed an electromagnetic signal to each radiating device 101.

In an exemplary embodiment, further, in order to prevent energy loss during transmission, when the power distributor 104 includes microstrip lines 105 and 105' with different impedances, as shown in FIG. 1, the power distributor 104 further includes an impedance transformer 106 electrically coupled between the microstrip lines 105 and 105' with different impedances so as to match the characteristic impedances of the microstrip lines 105 and 105'.

In addition, as will be understood by those skilled in the art, the liquid crystal antenna 100 should further include other components to enable it to work normally, such as a reference electrode that forms an electric field with the microstrip lines 105, 105' to adjust the alignment of the liquid crystal molecules, a controller that provides a low frequency voltage signal to the microstrip lines 105, 105' to control the alignment of the liquid crystal molecules accordingly.

In the liquid crystal antenna 100 shown in FIG. 1, the reference electrode, the microstrip line 107 and the liquid crystal region 103 implement the function of a phase shifter. In the liquid crystal antenna 100, the power distribution network feeds the electromagnetic signals into the radiating devices 101 in equal amplitude and same phase. The phase shifter changes the phase of the fed electromagnetic signals by changing the dielectric constant of the liquid crystal, and the phase-changed electromagnetic signals are transmitted through the radiating devices 101. By applying different voltages to the liquid crystal molecules corresponding to each of the radiating devices 101 via the microstrip line 107 and the reference electrode, the liquid crystal molecules will be deflected to different degrees, so that the phases of the fed electromagnetic signals will change differently.

However, the inventors of the present disclosure recognize that in the liquid crystal antenna shown in FIG. 1, the phase shifting function needs to be implemented by the liquid crystal, so the loss of electromagnetic signals in the liquid crystal is inevitable. However, the power distributor is only used to transmit electromagnetic signals in equal amplitude and same phase, and does not require the phase shifting function. Therefore, in the liquid crystal antenna 100 shown in FIG. 1, using the liquid crystal with a large transmission loss as a transmission medium greatly increases the transmission medium loss of the liquid crystal antenna.

Figure 2:
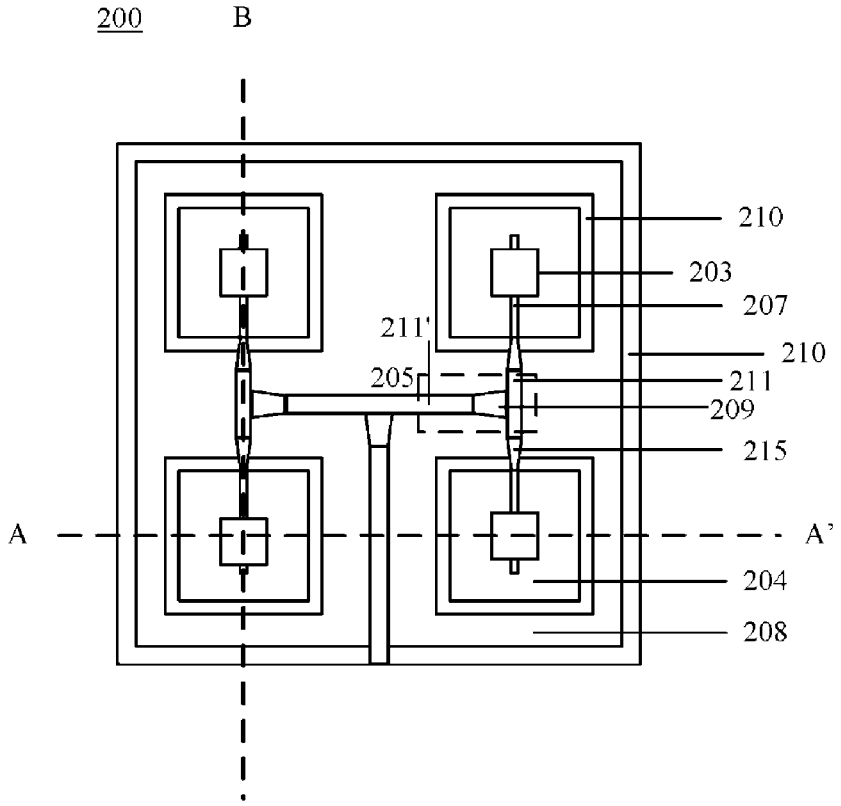
FIG. 2 schematically illustrates a top view of a liquid crystal antenna including a power distribution network according to an embodiment of the present disclosure.
Figure 3:
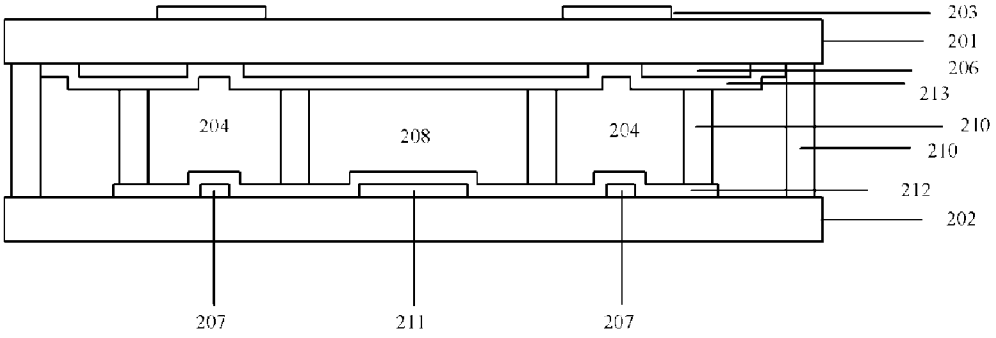
FIG. 3 schematically illustrates a cross-sectional view of the liquid crystal antenna taken along the A-A' direction of FIG. 2.
Figure 4:
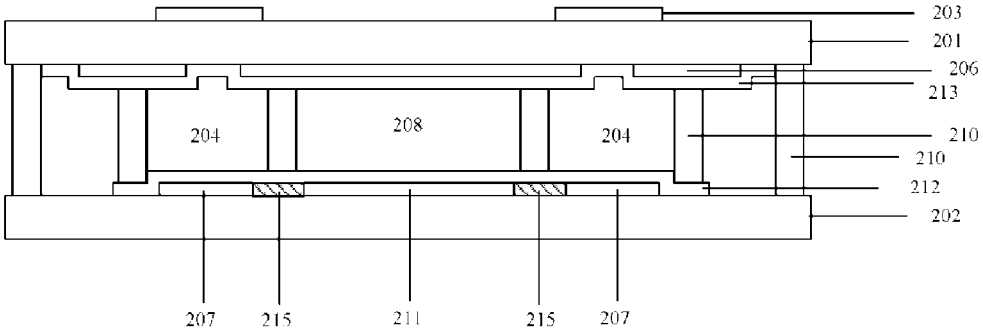
FIG. 4 schematically illustrates a cross-sectional view of the liquid crystal antenna taken along the B-B' direction of FIG. 2.

In view of this, embodiments of the present disclosure provide a power distribution network. FIG. 2 schematically illustrates a top view of a liquid crystal antenna 200 including a power distribution network according to an embodiment of the present disclosure, FIG. 3 schematically illustrates a cross-sectional view of the liquid crystal antenna 200 taken along the A-A' direction of FIG. 2, and FIG. 4 schematically illustrates a cross-sectional view of the liquid crystal antenna 200 taken along the B-B' direction of FIG. 2. As shown in FIGS. 2-4, the liquid crystal antenna 200 includes a first substrate 201 and a second substrate 202 opposite to each other. A plurality of radiating devices 203 are disposed on a side of the first substrate 201 away from the second substrate 202. The liquid crystal antenna 200 includes a power distribution network configured to feed electromagnetic signals to the plurality of radiating devices 203. The power distribution network includes a plurality of cascaded power distributors 205. Each power distributor 205 includes a transmission medium region 208, a first microstrip line 211 between the second substrate 202 and the transmission medium region 208, and a reference electrode 206 between the first substrate 201 and the transmission medium region 208. As shown in FIG. 2, the transmission medium regions 208 of the plurality of power distributors 205 are continuous with each other. Further, the liquid crystal antenna 200 includes a phase shifter. The phase shifter includes a plurality of liquid crystal regions 204 between the first substrate 201 and the second substrate 202, a reference electrode 206 between the first substrate 201 and the plurality of liquid crystal regions 204, and a second microstrip line 207 between the second substrate 202 and the plurality of liquid crystal regions 204. The second microstrip line 207 is configured to cooperate with the reference electrode 206 to control the alignment of liquid crystal molecules in each liquid crystal region 204.

In particular, respective one of the plurality of liquid crystal regions 204 corresponds to respective one of the plurality of radiating devices 203, an orthographic projection of each radiating device 203 on the second substrate 202 at least partially overlaps with an orthographic projection of the corresponding liquid crystal region 204 on the second substrate 202, and the transmission medium region 208 is disposed between adjacent liquid crystal regions 204, as shown in FIGS. 3 and 4. Moreover, a tangent value of a dielectric loss angle of the transmission medium in the transmission medium region 208 of each power distributor 205 is smaller than a tangent value of a dielectric loss angle of the liquid crystal in the liquid crystal region 204.

It should be noted that although FIG. 2 schematically illustrates a 2*2 liquid crystal array antenna, the concept of the present disclosure is not limited thereto, but can be applied to a liquid crystal antenna including any number of array elements. Further, the concept of the present disclosure is applicable not only to the liquid crystal microstrip antenna, but also to a liquid crystal phased array antenna with integrated transmission and reception functions.

In the above embodiments of the present disclosure, a liquid crystal region is provided in a region where a phase shifter function is required to ensure a large-angle phase shifting function of the phase shifter, while in other regions, the power distribution network uses another transmission medium other than the liquid crystal, the dielectric loss angle of the transmission medium is smaller than the dielectric loss angle of the liquid crystal. As used herein, the term "dielectric loss angle" is also referred to as a dielectric phase angle, which is a ratio of power distributed amount to the non-power distributed amount in the dielectric under AC voltage, and reflects the amount of energy loss in a unit volume within the dielectric. Compared with the liquid crystal antenna 100 shown in FIG. 1, by replacing the transmission medium in the region other than the region where the phase shifter function is required with a transmission medium having a smaller dielectric loss angle (that is, a smaller energy loss per unit volume), the power distribution network of the liquid crystal antenna 200 can substantially reduce the transmission loss generated by the liquid crystal in the power distribution network under the premise of ensuring that the input signals are equally distributed to the array elements in equal amplitude and same phase.

In an exemplary embodiment, as shown in FIGS. 2 and 4, the first microstrip line 211 includes a plurality of sub-microstrip lines 211 and 211' with different impedances, and each power distributor 205 further includes a first impedance transformer 209 electrically coupled between the sub-microstrip lines 211 and 211' with different impedances. When the load impedance and the characteristic impedance of the microstrip line are different or two microstrip lines with different characteristic impedances are connected, the transmitted signal will be reflected, thereby generating transmission loss. Therefore, an impedance transformer may be used between a load and a microstrip line that need to match the impedance or between two microstrip lines that need to match the impedance to achieve impedance matching, thereby reducing transmission loss. Therefore, as used herein, the term "impedance transformer" may also be referred to as an impedance matcher. In the 2*2 liquid crystal array antenna shown in FIG. 2, the input signals are transmitted to array elements in equal amplitude and same phase through one-divided-two power distributors which are cascaded. At each branch point, a first impedance transformer 209 is provided to achieve impedance matching of the power distribution network.

In some exemplary embodiments, the transmission medium in the transmission medium region 208 is air. In other words, the transmission medium region 208 is filled with air. In this way, the manufacturing process of the liquid crystal antenna can be simplified, and the manufacturing cost of the liquid crystal antenna can be reduced.

Optionally, as shown in FIG. 2, the transmission medium region 208 and the adjacent liquid crystal region 204 may be separated by a wall 210. In an exemplary embodiment, the wall 210 may be made of a frame sealant. For example, during the manufacturing process, different transmission medium regions inside the array antenna are separated by the frame sealant, and the liquid crystal is dripped in the region where the phase shifter function is required to ensure the large-angle phase shifting function of the phase shifter.

In particular, in an exemplary embodiment, a width of the first microstrip line may satisfy the following formula:

$$Z_{01} = \frac{60}{\sqrt{\varepsilon_{e1}}} \ln\left[\frac{\mu_1}{w_1/h_1} + \sqrt{1 + \left(\frac{2}{w_1/h_1}\right)^2}\right]$$

where $Z_{01}$ represents a characteristic impedance of the first microstrip line, $\varepsilon_{e1}$ represents an effective dielectric constant of the transmission medium in the transmission medium region 208, $\mu_1$ represents a magnetic permeability of the transmission medium in the transmission medium region 208, $w_1$ represents a width of the first microstrip line, and $h_1$ represents a thickness of the transmission medium region 208.

Similarly, in an exemplary embodiment, a width of the second microstrip line 207 may satisfy the following formula:

$$Z_{02} = \frac{60}{\sqrt{\varepsilon_{e2}}} \ln\left[\frac{\mu_2}{w_2/h_2} + \sqrt{1 + \left(\frac{2}{w_2/h_2}\right)^2}\right]$$

where $Z_{02}$ represents a characteristic impedance of the second microstrip line 207, $\varepsilon_{e2}$ represents an effective dielectric constant of the liquid crystal in the liquid crystal region 204, $\mu_2$ represents a magnetic permeability of the liquid crystal in the liquid crystal region 204, $w_2$ represents a width of the second microstrip line 207, and $h_2$ represents a thickness of the liquid crystal region 204.

In an exemplary embodiment, as shown in FIGS. 3 and 4, the liquid crystal antenna 200 may optionally further include a first alignment layer 212 between the liquid crystal region 204 and the second substrate 202, and a second alignment layer 213 between the liquid crystal region 204 and the first substrate 201. The first alignment layer 212 and the second alignment layer 213 cooperate with each other to set an initial alignment of the liquid crystal region 204.

Figure 5:
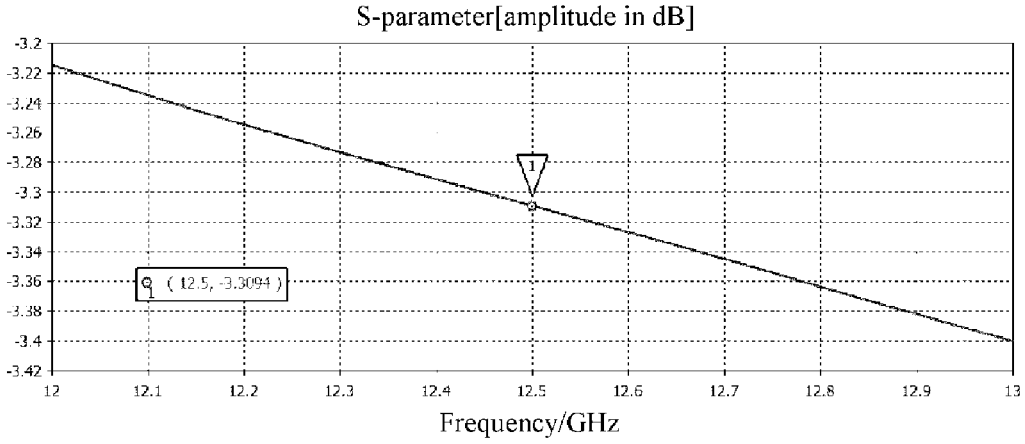
FIG. 5 shows a simulation result of transmission loss of a microstrip line in a liquid crystal.
Figure 6:
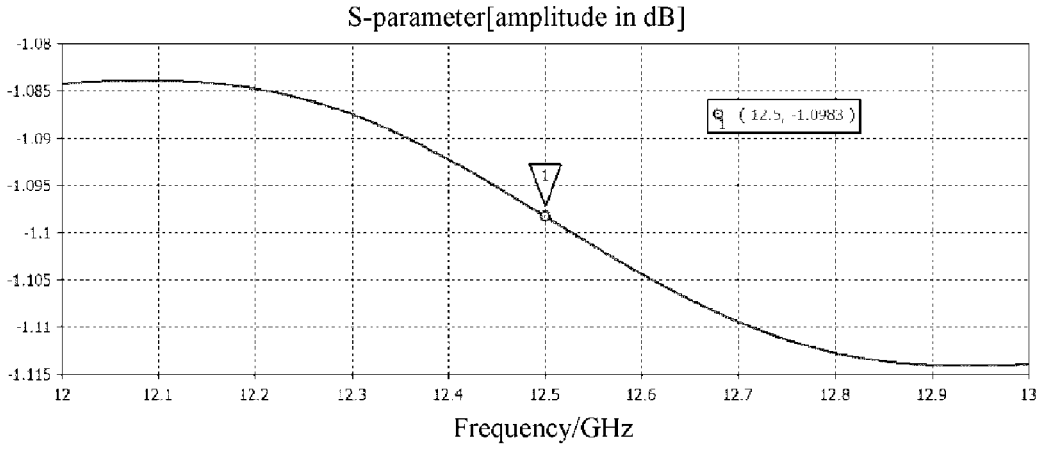
FIG. 6 shows a simulation result of transmission loss of a microstrip line in air.

FIG. 5 shows a simulation result of transmission loss when the microstrip line uses liquid crystal as a transmission medium and FIG. 6 shows a simulation result of transmission loss when the microstrip line uses air as a transmission medium. The power distribution network is mainly composed of microstrip lines, the difference between different power distribution networks is mainly the length of the microstrip line, and the transmission loss of the microstrip line has a linear relationship with its length. Therefore, the loss of power distribution networks including microstrip lines with different lengths may be speculated from the loss of a microstrip line with a specific length. Comparing FIG. 5 and FIG. 6, it can be seen that under the same power distribution network structure, the transmission losses of the microstrip line in these two different transmission media are significantly different. For example, as shown in FIG. 5 and FIG. 6, at the frequency of 12.5 GHz, the air transmission medium has a reduction in transmission loss by 2.2111 dB compared to the liquid crystal transmission medium. Therefore, converting part of the liquid crystal into air will greatly improve the transmission efficiency of the microstrip line.

Turning to FIG. 4, due to the change of the transmission medium, the widths of the first microstrip line 211 and the second microstrip line 207 are different under the premise of different transmission media, the same thickness and characteristic impedance. In order to reduce transmission loss, a second impedance transformer 215 may be added at the connection between the first microstrip line 211 and the second microstrip line 207. The second impedance transformer 215 starts at the wall 210, and its length and line width are determined by the dielectric constant of the wall 210 (in particular, the frame sealant). That is, different types of walls 210 correspond to the second impedance transformers 215 of different lengths and widths.

Further, an embodiment of the present disclosure further provides a communication device, which uses any one of the liquid crystal antennas described above.

In such communication device, a liquid crystal region is provided in a region where a phase shifter function is required to ensure a large-angle phase shifting function of the phase shifter, while in other regions, the power distribution network uses another transmission medium other than the liquid crystal, the dielectric loss angle of the another transmission medium is smaller than the dielectric loss angle of the liquid crystal. By replacing the transmission medium in the region other than the region where the phase shifter function is required with a transmission medium having a smaller dielectric loss angle (that is, a smaller energy loss per unit volume), the power distribution network of the liquid crystal antenna in the communication device can substantially reduce the transmission loss generated by the liquid crystal in the power distribution network under the premise of ensuring that the input signals are evenly distributed to the array elements in equal amplitude and same phase.

Unless defined otherwise, the technical or scientific terms used in the present disclosure shall have the ordinary meanings as understood by those of ordinary skill in the art to which this disclosure belongs. The terms "first", "second", and the like used in this disclosure do not indicate any order, quantity, or importance, but are only used to distinguish different components. Similarly, "a", "an", or "the" and the like do not indicate a limit on quantity, but rather indicate that there is at least one. Words such as "include" or "comprise" mean that the element or item preceding the word covers the element or item listed after the word and the equivalent thereof without excluding other elements or items. Words such as "connected" or "coupled" are not limited to physical or mechanical connections, but may include electrical connections, whether direct or indirect. "Up", "down", "left", "right", etc. are only used to indicate the relative position relationship. When the absolute position of the described object changes, the relative position relationship may also change accordingly. It should be noted that the features in the above embodiments can be used in any combination without conflict.

The above embodiments are only used for explanations rather than limitations to the present disclosure. The person of ordinary skill in the art, in the case of not departing from the spirit and scope of the present disclosure, may also make various modifications and variations. Therefore, all the equivalent solutions also belong to the scope of the present disclosure. The protection scope of the present disclosure should be defined by the claims.

The invention claimed is:

1. A liquid crystal antenna, comprising: a first substrate and a second substrate opposite to each other; a plurality of radiating devices on a side of the first substrate away from the second substrate; a power distribution network comprising a plurality of cascaded power distributors, each of the plurality of cascaded power distributors comprising a first microstrip line, a transmission medium region and a reference electrode, wherein the power distribution network is configured to feed electromagnetic signals to the plurality of radiating devices; a phase shifter comprising a plurality of liquid crystal regions between the first substrate and the second substrate, the reference electrode between the first substrate and the plurality of liquid crystal regions, and a second microstrip line between the second substrate and the plurality of liquid crystal regions, and a second impedance transformer electrically coupled between the first microstrip line and the second microstrip line adjacent to each other, wherein a tangent value of a dielectric loss angle of a transmission medium in the transmission medium region is smaller than a tangent value of a dielectric loss angle of a liquid crystal in the plurality of liquid crystal regions, wherein the transmission medium region of each power distributor is between adjacent liquid crystal regions, and the transmission medium region and a liquid crystal region adjacent to the transmission medium region are separated by a wall, and wherein an orthographic projection of the wall on the second substrate at least partially overlaps with an orthographic projection of the second impedance transformer on the second substrate, and a length and width of the second impedance transformer are associated with a dielectric constant of the wall.

2. The liquid crystal antenna according to claim 1, wherein the first microstrip line comprises a plurality of sub-microstrip lines with different impedances, and each power distributor further comprises a first impedance transformer electrically coupled between the first microstrip lines with different impedances.

3. The liquid crystal antenna according to claim 1, wherein the transmission medium in the transmission medium region is air.

4. The liquid crystal antenna according to claim 1, wherein a width of the first microstrip line satisfies the following formula:

$$Z_{01} = \frac{60}{\sqrt{\varepsilon_{e1}}} \ln\left[\frac{\mu_1}{w_1/h_1} + \sqrt{1 + \left(\frac{2}{w_1/h_1}\right)^2}\right]$$

where $Z_{01}$ represents a characteristic impedance of the first microstrip line, $\varepsilon_{e1}$ represents an effective dielectric constant of the transmission medium in the transmission medium region, $\mu_1$ represents a magnetic permeability of the transmission medium in the transmission medium region, $w_1$ represents a width of the first microstrip line, and $h_1$ represents a thickness of the transmission medium region.

5. A liquid crystal antenna, comprising: a first substrate and a second substrate opposite to each other; a plurality of radiating devices on a side of the first substrate away from the second substrate; a power distribution network comprising a plurality of cascaded power distributors, each of the plurality of cascaded power distributors comprising a first microstrip line, a transmission medium region and a reference electrode, wherein the power distribution network is configured to feed electromagnetic signals to the plurality of radiating devices; and a phase shifter comprising: a plurality of liquid crystal regions between the first substrate and the second substrate, the reference electrode between the first substrate and the plurality of liquid crystal regions, and a second microstrip line between the second substrate and the plurality of liquid crystal regions; and a second impedance transformer electrically coupled between the first microstrip line and the second microstrip line adjacent to each other, wherein, respective one of the plurality of liquid crystal regions corresponds to respective one of the plurality of radiating devices, and an orthographic projection of each radiating device on the second substrate at least partially overlaps with an orthographic projection of the corresponding liquid crystal region on the second substrate; the transmission medium region of each power distributor is between adjacent liquid crystal regions, the reference electrode of each power distributor is between the first substrate and the transmission medium region, and the first microstrip line of each power distributor is between the second substrate and the transmission medium region; a tangent value of a dielectric loss angle of a transmission medium in the transmission medium region is smaller than a tangent value of a dielectric loss angle of a liquid crystal in the plurality of liquid crystal regions; the transmission medium region and a liquid crystal region adjacent to the transmission medium region are separated by a wall; and an orthographic projection of the wall on the second substrate at least partially overlaps with an orthographic projection of the second impedance transformer on the second substrate, and a length and width of the second impedance transformer are associated with a dielectric constant of the wall.

6. The liquid crystal antenna according to claim 5, wherein the wall is made of a frame sealant.

7. The liquid crystal antenna according to claim 5, wherein a width of the second microstrip line satisfies the following formula:

$$Z_{02} = \frac{60}{\sqrt{\varepsilon_{e2}}} \ln\left[\frac{\mu_2}{w_2/h_2} + \sqrt{1 + \left(\frac{2}{w_2/h_2}\right)^2}\right]$$

where $Z_{02}$ represents a characteristic impedance of the second microstrip line, $\varepsilon_{e2}$ represents an effective dielectric constant of the liquid crystal in the liquid crystal region, $\mu_2$ represents a magnetic permeability of the liquid crystal in the liquid crystal region, $w_2$ represents a width of the second microstrip line, and $h_2$ represents a thickness of the liquid crystal region.

8. A communication device comprising the liquid crystal antenna according to claim 5.

* * * * *